US009784528B2

(12) United States Patent
Rockwell

(10) Patent No.: US 9,784,528 B2
(45) Date of Patent: Oct. 10, 2017

(54) SPECIAL AUTOMATIC OUT THE FRONT KNIFE TRANSFORMED AS A BAYONET

(71) Applicant: Tracey Rockwell, Atlanta, IN (US)

(72) Inventor: Tracey Rockwell, Atlanta, IN (US)

( * ) Notice: Subject to any disclaimer, the term of this patent is extended or adjusted under 35 U.S.C. 154(b) by 0 days.

(21) Appl. No.: 14/803,043

(22) Filed: Jul. 18, 2015

(65) Prior Publication Data

US 2016/0216063 A1 Jul. 28, 2016

Related U.S. Application Data

(60) Provisional application No. 62/026,883, filed on Jul. 21, 2014.

(51) Int. Cl.
*F41C 27/18* (2006.01)

(52) U.S. Cl.
CPC ..... *F41C 27/18* (2013.01)

(58) Field of Classification Search
CPC ..... F41C 27/18; F41C 27/16
USPC ..... 42/84
See application file for complete search history.

(56) References Cited

U.S. PATENT DOCUMENTS 545,528 A 9/1895 Paul
1,055,416 A 3/1913 Pliones et al.
1,246,258 A * 11/1917 Gerace ..... F41C 27/18 30/162
1,260,827 A 3/1918 Stefanov
1,290,807 A 1/1919 Tomanek
1,314,672 A 9/1919 Kozlowski
1,504,073 A * 8/1924 Moore ..... F41C 27/18 30/162
1,614,353 A * 1/1927 Ebert ..... F41C 27/18 30/142
2,330,637 A 9/1943 Spagnolo
2,665,478 A 1/1954 Clemens
5,722,169 A 3/1998 Ozden
6,810,614 B2 * 11/2004 Phillips ..... F41C 27/00 42/75.01
D527,788 S * 9/2006 Kellgren ..... D22/118

FOREIGN PATENT DOCUMENTS

DE 3225722 * 1/1984 ..... F41C 27/02

* cited by examiner

*Primary Examiner* — Stephen M Johnson
(74) *Attorney, Agent, or Firm* — John D Ritchison; Ritchison Law Offices, PC

(57) ABSTRACT

A special automatic out the front knife device transformed as a bayonet for rifles, shotguns and pistols. Particularly this knife product is related to rifle, pistol and shotgun applications where having a knife or bayonet readily available is desired. The device is to be used with a weapon such as a rifle, shotgun or pistol and is comprised of an out-the front, encased spring activated blade component and at least one manner or way for connecting the blade component to the weapon wherein the out-the front, encased spring activated blade component which can be removably secured to the rifle, shotgun or pistol for use as a bayonet.

11 Claims, 18 Drawing Sheets

Prior Art Patent

Prior Art Patent

Prior Art Patent

Prior Art Patent

74

Prior Art Patent

73

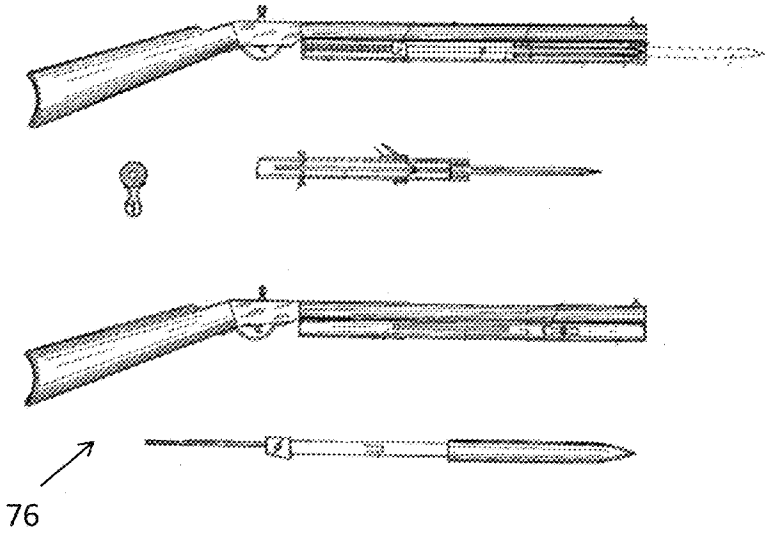
Prior Art Patent
Fig. 18 B
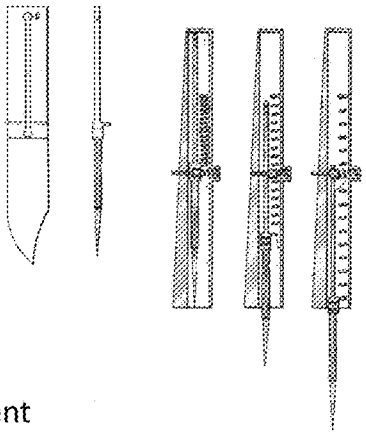
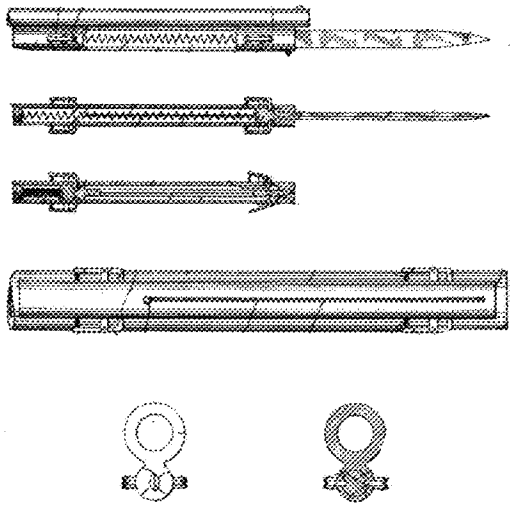
Prior Art Patent
Fig. 18 A
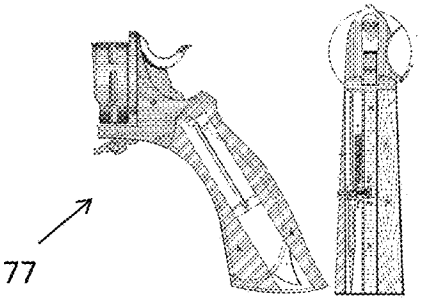
Fig. 18 C Prior Art Patent

SPECIAL AUTOMATIC OUT THE FRONT KNIFE TRANSFORMED AS A BAYONET

CROSS-REFERENCE TO RELATED APPLICATIONS

This application claims the benefit of U.S. Provisional Patent Application with Ser. No. 62/026,883 filed Jul. 21, 2014 by Tracey Rockwell and entitled "Special Automatic out the front knife transformed as a bayonet".

FIELD OF INVENTION

This invention relates to a special automatic out the front knife transformed as a bayonet for rifles, shotguns and pistols. Particularly this knife product is related to rifle, pistol and shotgun applications where having a knife or bayonet readily available is desired.

The special automatic out the front knife transformed as a bayonet is a readily made and available Automatic out the front knife product transformed as a bayonet for mounting to rifles, pistols and shotguns. The device is secured to the weapons and the barrel of the weapon by various means. The applications anticipate original equipment with rifles, pistols and shotguns or as aftermarket uses described and discussed below.

FEDERALLY SPONSORED RESEARCH

None.

SEQUENCE LISTING OR PROGRAM

None.

BACKGROUND—FIELD OF INVENTION AND PRIOR ART

As far as known, there are no special automatic out the front knife transformed as a bayonet or the like. It is believed that this product is unique in its design and technologies.

BACKGROUND

A background as to bayonets and spring knives is useful. A bayonet mount is a fast, secure, and precise way to join two pieces of equipment temporarily. This mount employs two or three pins or wedges that are positioned into slots or grooves of another piece. The connection is made with a twist and a compression force of one piece into the other. This coupling mechanism was first used by the French around the 1670s. Earlier soldiers had discovered the effectiveness of jamming knives into the barrels of their muskets once engaged in close-quarter battles. The disadvantage of the adaption was that the muskets could not be fired until the knives were removed. Gunsmiths set to work on this problem and developed a short tube that fit over the end of the barrel and was locked in place by use of a pin through a zigzag slot. The blade was welded to the side. Peaceful applications of the bayonet mount became plentiful with the development of manufacturing standards and engineering drawings with matched tolerances for connecting equipment. They are commonly used in camera equipment to attach a removable lens to the camera body. The precision alignment of the tight-tolerance pieces ensures the face of the lens is parallel to the camera body, avoiding distortion of the picture.

A bayonet lug is a standard feature on most military muskets, rifles, and shotguns, and on some civilian longarms. It is intended for attaching a bayonet, which is typically a long spike or thrusting knife. The bayonet lug is the metal mount that either locks the bayonet onto the weapon or provides a base for the bayonet to rest against, so that when a bayonet thrust is made, the bayonet does not move or slip backwards. Less than 400 years ago, bayonet lugs or their predecessors that allowed them to slip over the barrel did not exist. Prior to the lug's invention, bayonets merely stuffed into the muzzle's end from a tight-fitting stub, rendering the firearm virtually useless and certainly preventing it from being discharged. But by the late 17th century, this type of bayonet was entirely phased out and subsequently replaced with the socket bayonet that slides over the muzzle with the blade offset to the side, just above or underneath. Bayonet lugs are usually located near the muzzle end of a musket, rifle, or other longarm barrel. The lug is occasionally placed on top of the barrel, if serving as the base of the front sight, or more often mounted to the side or bottom of the barrel.

To couple and attach the two parts, the pin(s) on the male are aligned with the slot(s) on the female and the two pushed together. Once the pins reach the bottom of the slot, one or both parts are rotated so that the pin slides along the horizontal arm of the L until it reaches the "serif". The spring then pushes the male connector up into the "serif" to keep the pin locked into place. A practiced user can connect them quickly and, unlike screw connectors, they are not subject to cross-threading. To disconnect, the two parts are pushed together to move the pin out of the "serif" while twisting in the opposite direction than for connecting, and then pulling apart. The strength of the joint comes from the strength of the pins and the L slots, and the spring. To disengage unintentionally, the pins must break, the sleeve into which the connector slides must be distorted or torn enough to free the pins, or the spring must fail and allow the connector to be pushed down and rotate due to, say, vibration. It is possible to push down the connector and rotate it, but not far enough to engage and lock; it will stay in place temporarily, but accidental disconnection is very likely.

Switchblade knives were invented in the early part of the 20th century. During the 1950's the switchblade got a bad reputation as it was identified with gangs which were popularized by such movies as "On the Waterfront", etc. As a result in the late 1950's most states passed laws outlawing the possession of switchblade knives. A Federal statute was passed to make it unlawful to ship switchblades across state lines, unless being shipped to a law enforcement or military agency. Here we will explain the difference between illegal switchblade knives, and legal spring assisted opening knives. All switchblades have some characteristics in common. They have a spring which exerts constant pressure on the blade. The knife is held in the closed position by the mechanism of the knife. This mechanism is released by depressing the button (which all switchblades have), allowing the stored energy the spring is exerting on the blade to propel the blade from the handle and open the knife. It is important to remember that the natural position of the switchblade knife is OPEN, it is held closed only by the locking mechanism. On the other hand, the natural position of the spring assisted opening knife is CLOSED. There is no pressure being exerted upon the blade, and there is no button to push. Spring assisted knives employ the following opening methods. 1) A "Flipper" or lever which is located on the back spine of the knife. This flipper is actually an integral part of the blade which protrudes from the back spine of the knife when it is in the closed position. This is the most common opening mechanism of spring assisted knives. 2). A thumb stud, the same as is found on most all tactical folding knives. In either case, either flicking the "flipper" or pushing out the thumb stud begins opening the blade, at which point the assisted opening mechanism takes over and finishes opening the blade. Performance wise, there is very little (if any) difference in the opening speed of a switchblade and a spring assisted knife. However, the differences in the way they are made make the spring assisted knives legal in all 50 U.S. states (They are not legal in the 5 boroughs of New York City, but this is because all locking blade knives have been held to be illegal in NYC, not just the spring assisted ones).

Problem Solved

The improvement and problem solved as to bayonets and spring knives should be useful. A bayonet mount is a fast, secure, and precise way to mount but the ever-present knife blade presents a risk to personnel and equipment when the "blade" is not needed. However, the time to assemble and remove a fixed bayonet can be cumbersome and a delay can prove deadly. The ability to have the Automatic out the front knife transformed as a bayonet resolves the ever-present and potentially dangerous blade as well as the time to place and secure a traditional bayonet.

PRIOR ART

The improvement and problem solved as to bayonets and spring out front knives have some historical prior art. However they do not solve the problem effectively as the present Rockwell device. The device taught by Tomanek in U.S. Pat. No. 1,290,807 issued in 1919 shows a spring loaded device for a rifle but lacks the simple attachment and few parts in comparison with the Rockwell device. Another device by U.S. Pat. No. 2,330,637 issued to Spagnolo in 1943 reveals a hinged flip-op knife with more complexity and less universality than Rockwell's invention.

Another U.S. Pat. No. 1,055,416 issued to Pliones and Collias in 1913 provided a complex spring activated knife for a rifle or shotgun but failed the simple configuration shown with the Rockwell device. U. S. Pat. No. 2,665,478 by Clemens in 1954 is a leg/shin mounted knife which fails the form, fit and function of the Rockwell out-the-front knife device.

Another U.S. Pat. No. 5,722,169 by Ozden issued in 1998 taught a pointed weapon with a springing device. Here was taught a springing, pointed device absent from a weapon such as a rifle or shotgun. It does not anticipate the Rockwell invention. Another U.S. Pat. No. 1,260,827 shows a forward thrust and disappearing bayonet. Issued to Stefanov in 1918, the device appears more complex than Rockwell and limited to certain military rifles.

In 1919 a U.S. Pat. No. 1,314,672 was issued to Kozlowski that taught an "automatic bayonet". This is far more complex and less flexible than Rockwell. Finally, a U.S. Pat. No. 545,528 issued to Paul in 1895 revealed a specialized knife/bayonet used with a pistol. It was limited as used with universal weapons as taught by the instant Rockwell device.

SUMMARY OF THE INVENTION

This invention is an Automatic out the front knife transformed as a bayonet device for various applications. Taught here are the ways an automatic out the front knife may be transformed for use as a bayonet for rifles, pistols and shotguns.

The preferred embodiment of a special automatic out the front knife device transformed as a bayonet, the knife device to be used in conjunction with a weapon, such as a rifle, shotgun or pistol and the knife device is comprised of: (a) an out-the front, encased spring activated blade component; and (b) at least one means for connecting the blade component to the weapon wherein the out-the front, encased spring activated blade component can be removably secured to the rifle, shotgun or pistol for use as a bayonet or the like.

The newly invented special automatic out the front knife transformed as a bayonet device for various applications may be manufactured at low volumes by very simple means and in high volume production by more complex and controlled systems.

OBJECTS AND ADVANTAGES

There are several objects and advantages of the special automatic out the front knife transformed as a bayonet device. There are currently no known special automatic out the front knife transformed as a bayonet devices that are effective at providing the objects of this invention.

Special automatic out the front knife transformed as a bayonet device has various advantages and benefits:

| Item | Advantages |
|---|---|
| 1 | Fast to install |
| 2 | Most parts already produced |
| 3 | Universal designs for attachments to fit different rifles, shot guns, and pistols |
| 4 | Use by hunters, sportsman, law enforcement and military |
| 5 | Defensive and offensive modes |

Finally, other advantages and additional features of the present special automatic out the front knife transformed as a bayonet device will be more apparent from the accompanying drawings and from the full description of the device. For one skilled in the art of bayonets, firearms and automatic out the front knife devices, it is readily understood that the features shown in the examples with this product are readily adapted to other types of out the front knife and bayonet systems and devices.

DESCRIPTION OF THE DRAWINGS—FIGURES

The accompanying drawings, which are incorporated in and constitute a part of this specification, illustrate an embodiment of the automatic out the front knife transformed as a bayonet device for various applications device that is preferred. The drawings together with the summary description given above and a detailed description given below serve to explain the principles of the special automatic out the front knife transformed as a bayonet device. It is understood, however, that the special automatic out the front knife transformed as a bayonet device is not limited to only the precise arrangements and instrumentalities shown.

Figure 1A:
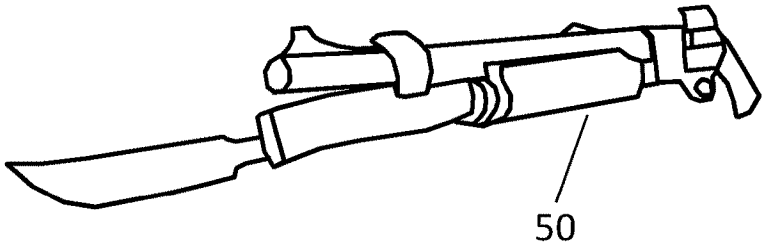
FIGS. 1A through 1D are sketches of the general automatic out of the front knife bayonet for rifle and pistol applications.
Figure 1B:
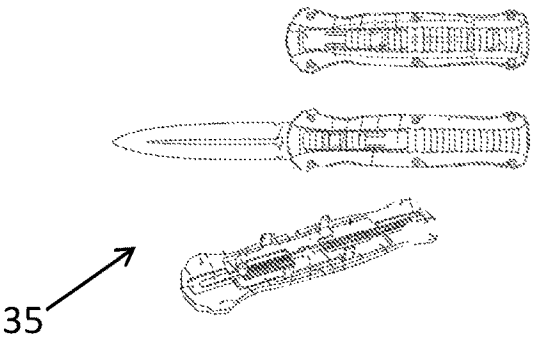
Figure 1C:
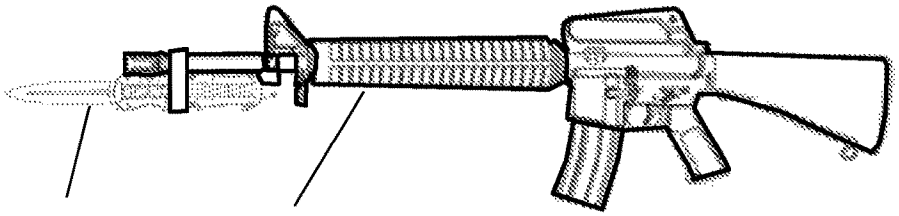
Figure 1D:
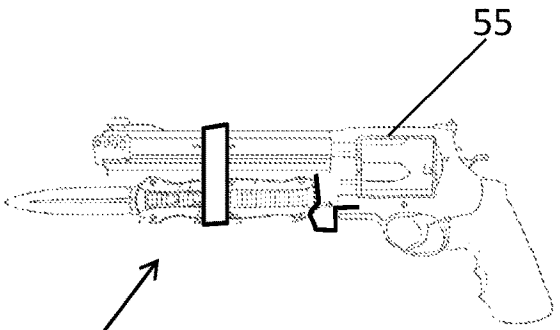
Figure 2A:
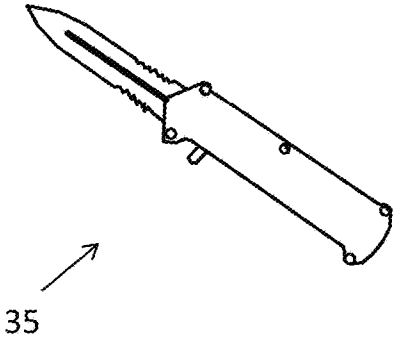
FIGS. 2A through 2E are sketches of the general automatic out of the front knife device with components and features noted.
Figure 2B:
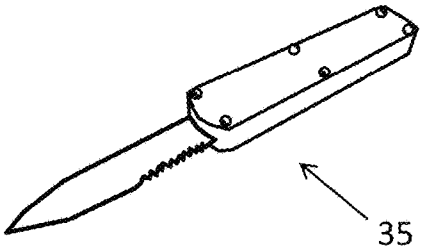
Figure 2C:
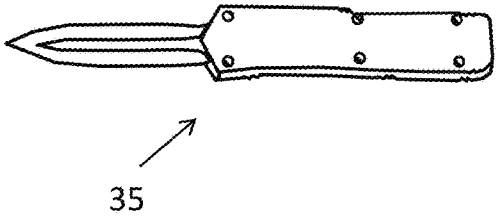
Figure 2D:
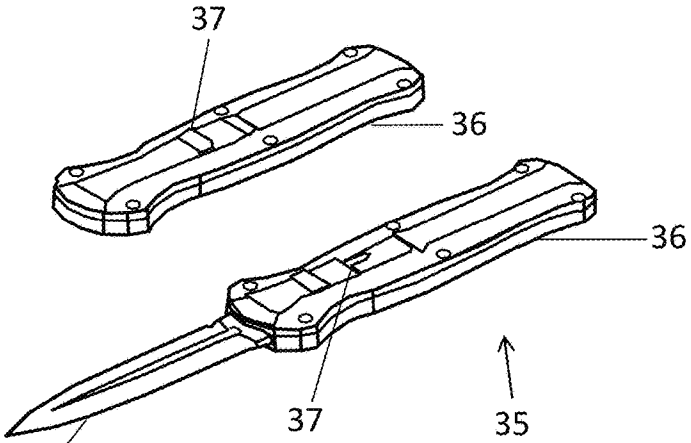
Figure 2E:
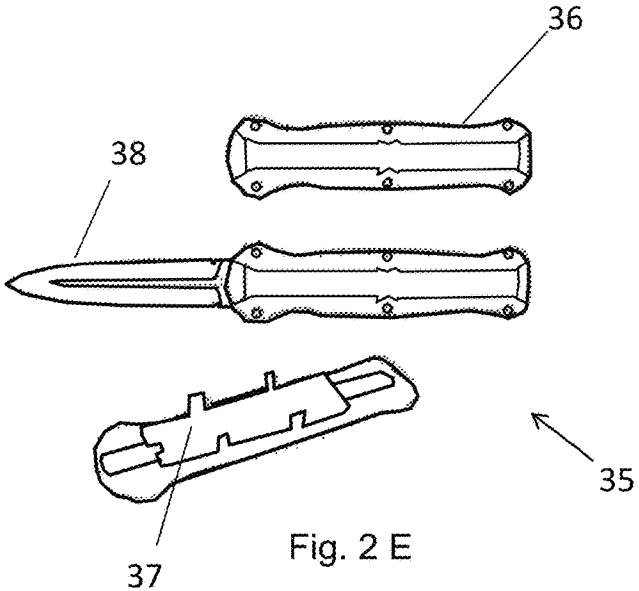

FIG. 16A through 16C, FIGS. 17A and 17B, and FIGS. 18A through 18C are sketches of prior art.

DESCRIPTION OF THE DRAWINGS—REFERENCE NUMERALS

The following list refers to the drawings:

TABLE B

| Reference numbers | |
|---|---|
| Ref # | Description |
| 30 | automatic out the front knife transformed as a bayonet device 30 |
| 30A | closed automatic knife - ready for extension 30A |
| 35 | automatic out the front knife 35 |
| 36 | case 36 |
| 37 | release trigger 37 |
| 38 | blade 38 |
| 39 | partially extended blade 39 |
| 42 | tomahawk 42 |
| 44 | flashlight/vertical extension structure 44 |
| 45 | fastener 45 (quick) wing nut, thumb screw or pair of thumb screws, or equal |
| 46 | gun sights 46 |
| 47 | slide keep 47 |
| 48 | grip 48 |
| 48A | grip barbs 48A |
| 49 | latch 49 (hinged or pinned) |
| 50 | rifle 50 |
| 51 | rifle barrel 51 |
| 52 | bayonet catch/clip 52 a/k/a bayonet lug |
| 53 | barrel ring 53 |
| 53A | end ring 53A |
| 53B | stock ring 53B |
| 55 | pistol 55 |
| 56 | rifle stock 56 |
| 59 | mil spec 1913 accessory rail 59 |
| 60 | user 60 |

TABLE B-continued

| Reference numbers | |
|---|---|
| Ref # | Description |
| 70 | prior Art 70 U.S. Pat. No. 1,290,807 |
| 71 | prior Art 71 U.S. Pat. No. 2,330,638 |
| 72 | prior Art 72 U.S. Pat. No. 1,055,416 |
| 73 | prior Art 73 U.S. Pat. No. 2,665,478 |
| 74 | prior Art 74 U.S. Pat. No. 5,722,169 |
| 75 | prior Art 75 U.S. Pat. No. 1,260,827 |
| 76 | prior Art 76 U.S. Pat. No. 1,314,672 |
| 77 | prior Art 77 U.S. Pat. No. 545,528 |

DETAILED DESCRIPTION OF PERFERRED EMBODIMENT

The present development is a special automatic out the front knife transformed as a bayonet device. This invention relates to a special automatic out the front knife transformed as a bayonet for rifles, shotguns and pistols. Particularly this knife product is related to rifle, pistol and shotgun applications where having a knife or bayonet readily available is desired. The special automatic out the front knife transformed as a bayonet is a readily made and available automatic out the front knife product transformed as a bayonet for mounting to rifles, pistols and shotguns. The device is secured to the weapons and the barrel of the weapon by various means. The applications anticipate original equipment with rifles, pistols and shotguns or as aftermarket uses described and discussed below.

The advantages for the special automatic out the front knife transformed as a bayonet device 30 are listed above in the introduction. Succinctly the benefits are that the device:

- Fast to install
- Most parts already produced
- Universal designs for attachments to fit different rifles, shot guns, and pistols
- Use by hunters, sportsman, law enforcement and military
- Defensive and offensive modes The preferred embodiment of a special automatic out the front knife device transformed as a bayonet device 30, the knife device to be used in conjunction with a weapon, such as a rifle, shotgun or pistol and the knife device is comprised of: (a) an out-the front, encased spring activated blade component; and (b) at least one means for connecting the blade component to the weapon wherein the out-the front, encased spring activated blade component can be removably secured to the rifle, shotgun or pistol for use as a bayonet or the like.

There is shown in FIGS. 1-18 a complete description and operative embodiment of the special automatic out the front knife transformed as a bayonet device. In the drawings and illustrations, one notes well that the FIGS. 1-18 demonstrate the general configuration and use of this product. The various example uses are in the operation and use section, below.

The accompanying drawings, which are incorporated in and constitute a part of this specification, illustrate an embodiment of the special automatic out the front knife transformed as a bayonet device 30 that is preferred. The drawings together with the summary description given above and a detailed description given below serve to explain the principles of the special automatic out the front knife transformed as a bayonet device 30. It is understood, however, that the special automatic out the front knife transformed as a bayonet device 30 is not limited to only the precise arrangements and instrumentalities shown. Other examples of bayonet and out-the-front automatic knives used as bayonets as devices and uses are still understood by one skilled in the art of bayonet, knife sporting and military defensive and offensive weapons devices to be within the scope and spirit shown here.

FIGS. 1A through 1D are sketches of the general automatic out of the front knife bayonet for rifle and pistol applications. Here are demonstrated an automatic out the front knife transformed as a bayonet device 30; automatic out the front knife 35; rifle 50; and pistol 55.

FIGS. 2A through 2E are sketches of the general automatic out of the front knife device with components and features noted. Shown here are: an automatic out the front knife 35; case 36; release trigger 37; and blade 38. The knife 35 may be actuated to automatically thrust the knife blade 38 out the front, then equally the blade 38 be retracted automatically. These features are well known in the field of knives by a person of ordinary skill in this field. The mount may be separate from the knife or integrated into the case and structure.

Figure 3B:
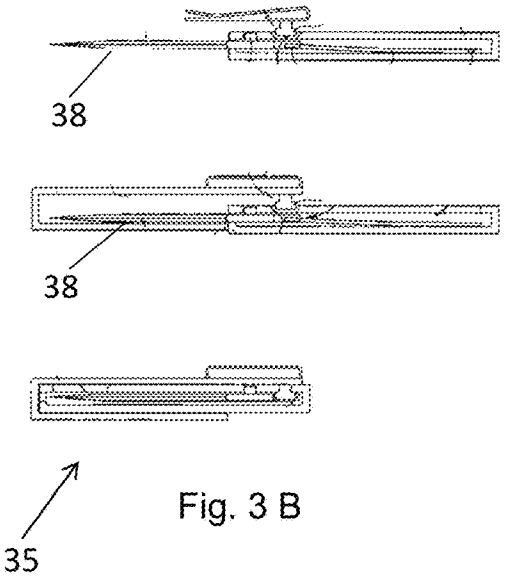
FIGS. 3A through 3C are additional sketches of an automatic out the front knife with the components and features shown from generally a top view.
Figure 3A:
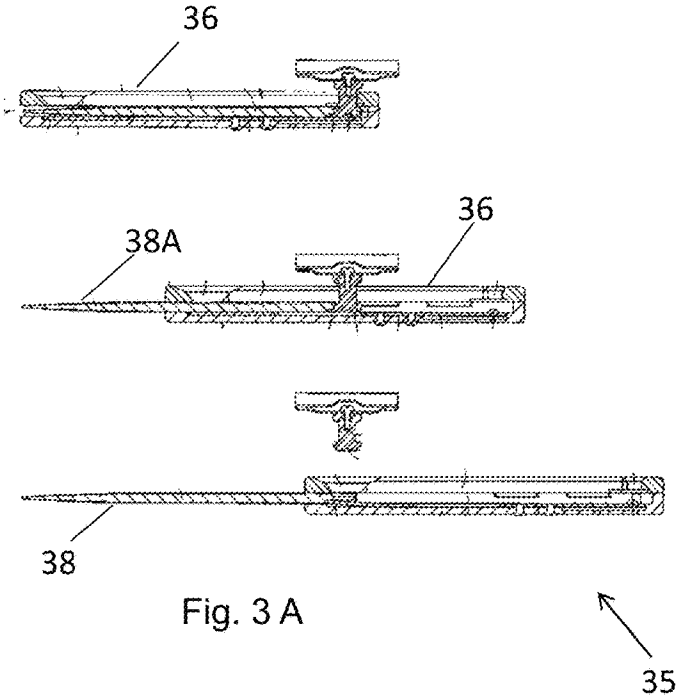
Figure 3C:
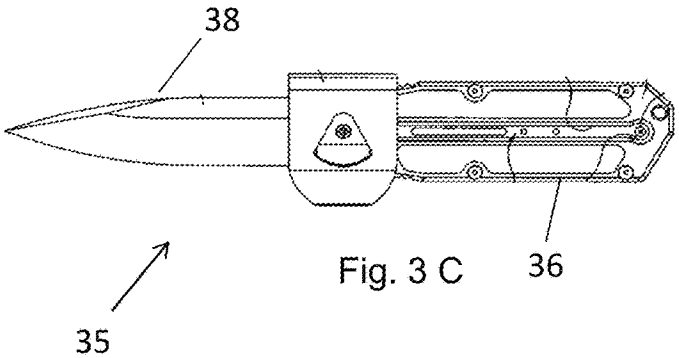

FIGS. 3A through 3C are additional sketches of an automatic out the front knife with the components and features shown from generally a top view. Again are shown an automatic out the front knife 35; case 36; release trigger 37; blade 38; and partially extended blade 39.

Figure 4B:
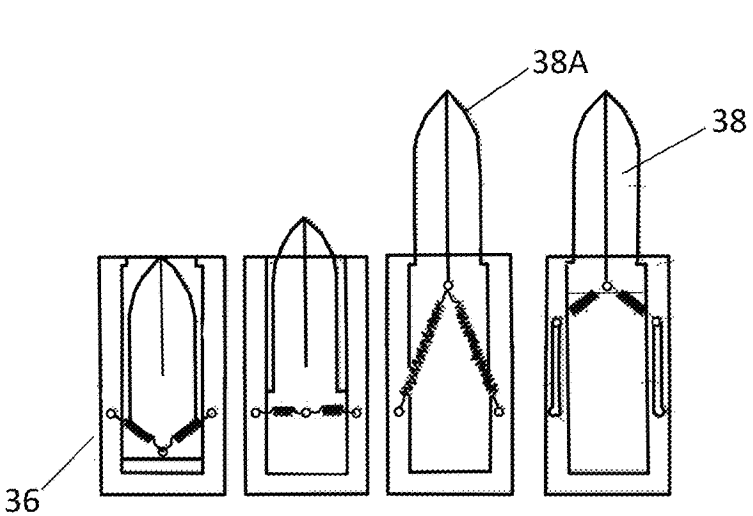
FIGS. 4A through 4C are even more sketches of the automatic out of front knives.
Figure 4A:
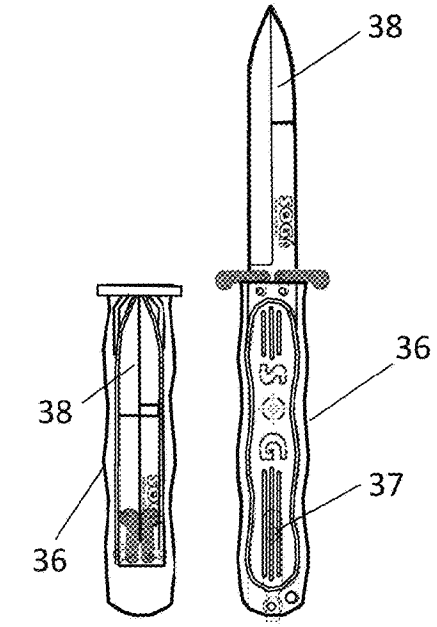
Figure 4C:
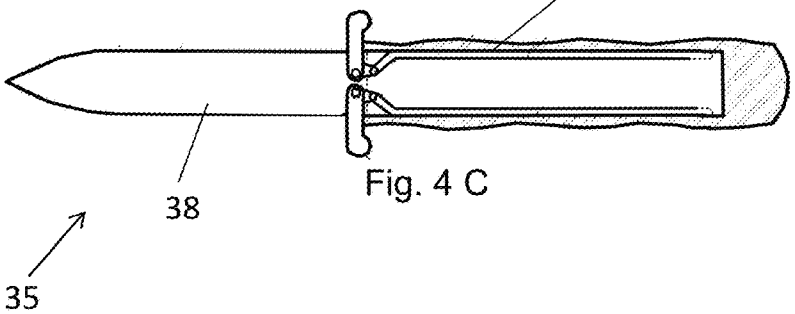

FIGS. 4A through 4C are even more sketches of the automatic out of front knives. Once more are shown an automatic out the front knife 35; case 36; release trigger 37; blade 38; and partially extended blade 39.

Figure 5A:
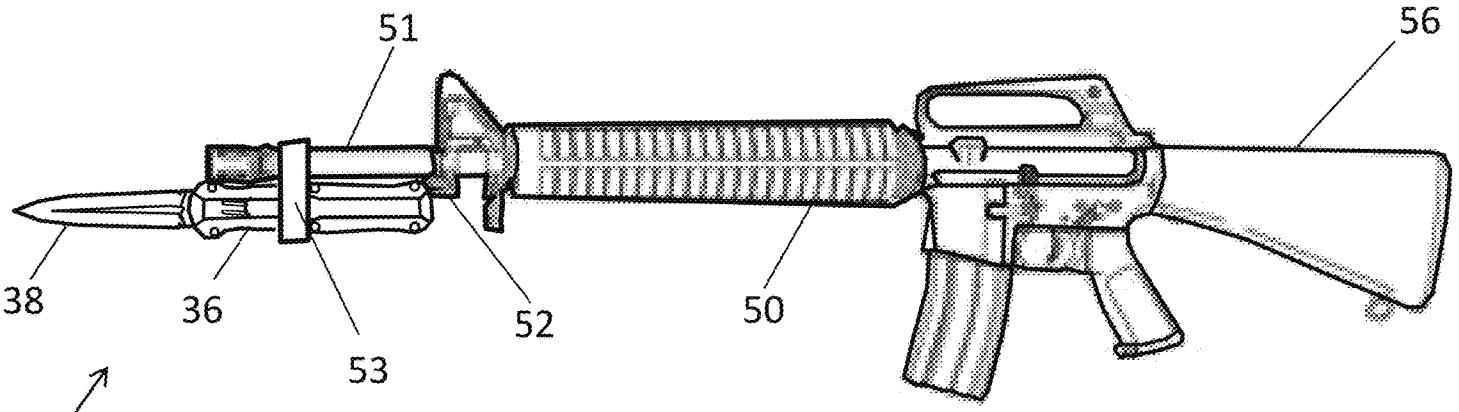
FIGS. 5A and 5B are sketches of an out the front automatic knife mounted as a bayonet on a rifle.
Figure 5B:
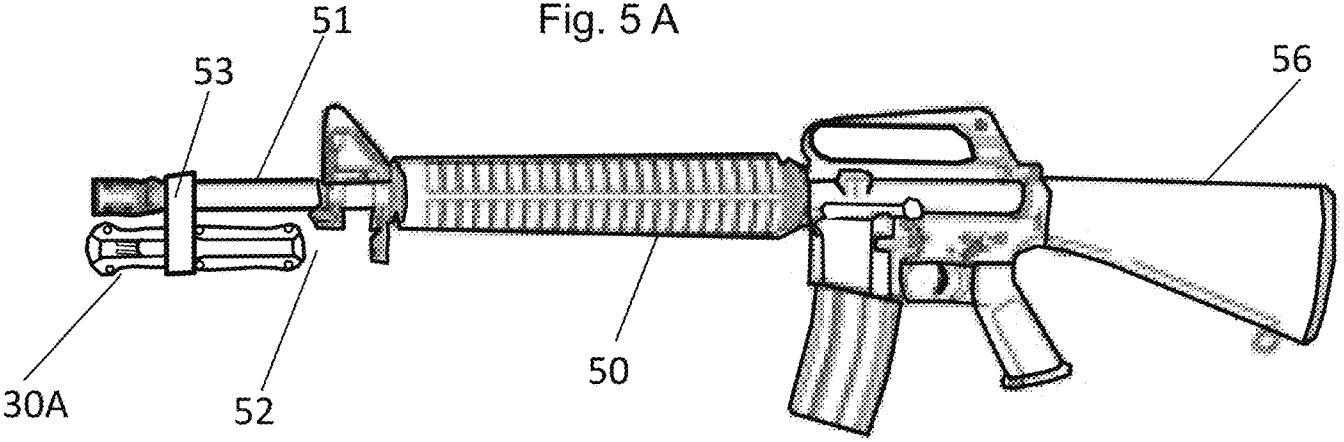
Figure 6A:
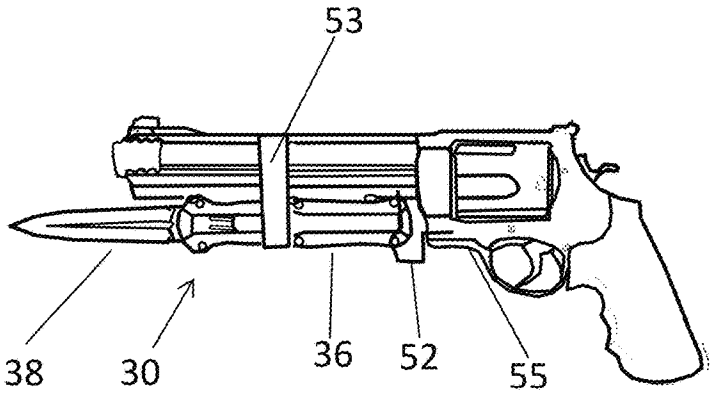
FIG. 6A through 6D are sketches of automatic out the front knives mounted on pistols.
Figure 6B:
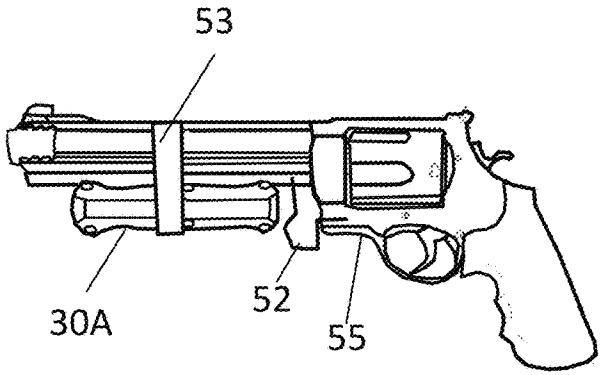
Figure 6C:
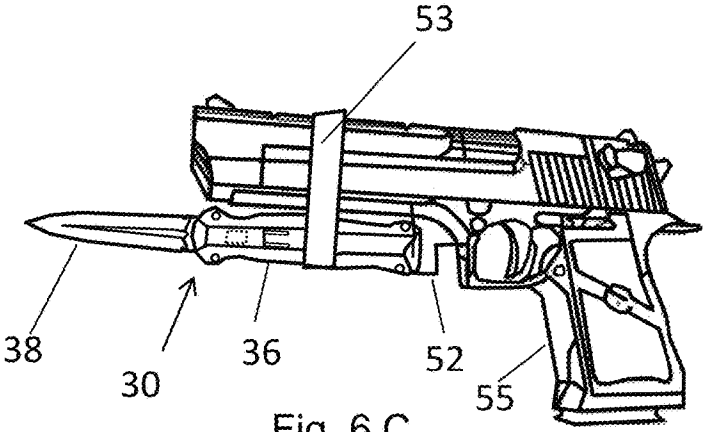
Figure 6D:
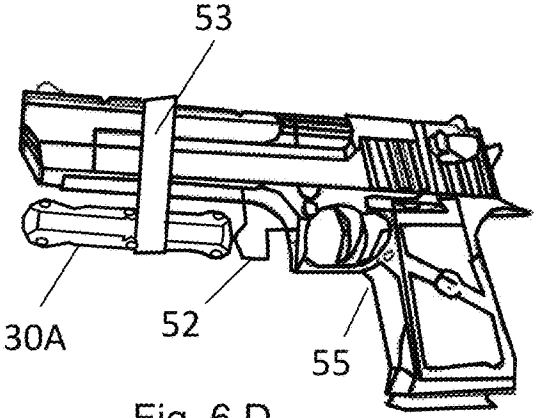
Figure 7C:
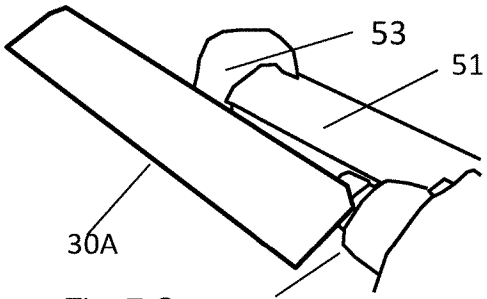
FIG. 7A through 7G are sketches of automatic out the front knives mounted with attachment rings and a bayonet connector/catch or lug.
Figure 7D:
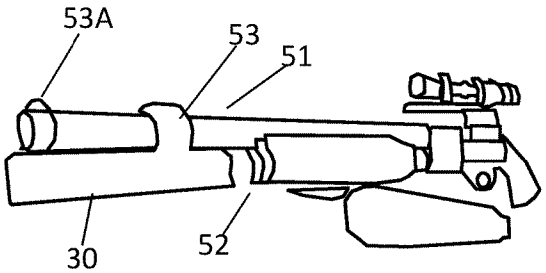
Figure 7G:
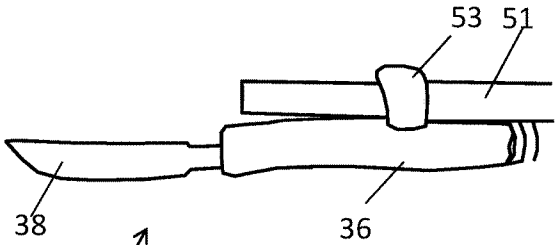
Figure 7A:
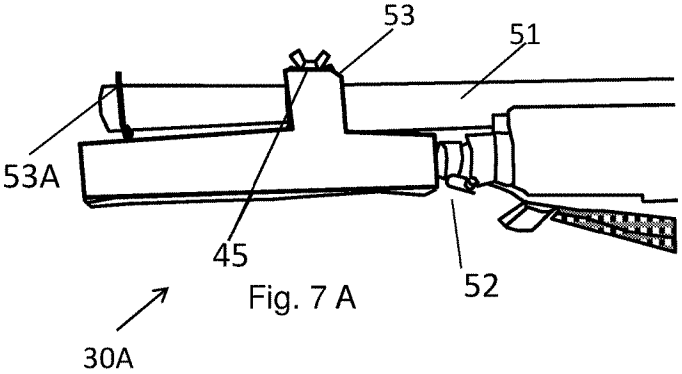
Figure 7B:
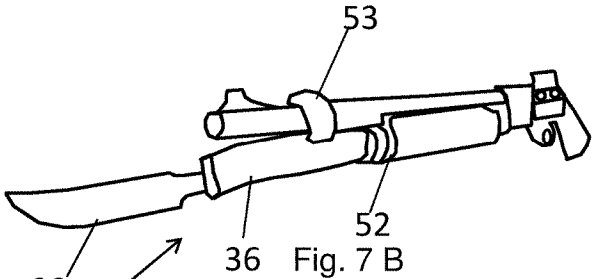
Figure 7F:
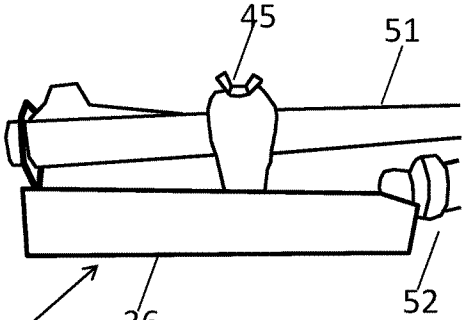
Figure 7E:
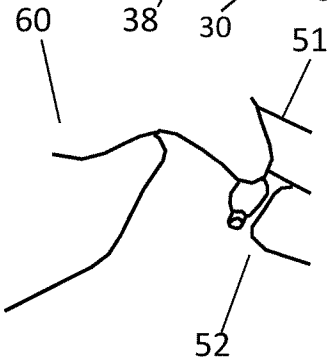

FIGS. 5A and 5B are sketches of an out the front automatic knife mounted as a bayonet on a rifle. Demonstrated are the mountings and components for a rifle including: automatic out the front knife transformed as a bayonet device 30; closed automatic knife—ready for extension 30A; automatic out the front knife 35; case 36; rifle 50; rifle barrel 51; bayonet catch/clip 52 a/k/a bayonet lug; barrel ring 53; and rifle stock 56.

FIGS. 6A through 6D are sketches of automatic out the front knives mounted on pistols. Demonstrated are the mountings and components for pistols including: automatic out the front knife transformed as a bayonet device 30; closed automatic knife—ready for extension 30A; case 36; blade 38 bayonet catch/clip 52 a/k/a bayonet lug; barrel ring 53; and pistol 55.

FIGS. 7A through 7G are sketches of automatic out the front knives mounted with attachment rings 53, 53A and a bayonet connector/catch or lug 52.Once again are shown: automatic out the front knife transformed as a bayonet device 30; closed automatic knife—ready for extension 30A; case 36; blade 38; fastener 45(quick) wing nut, thumb screw or pair of thumb screws, or equal; rifle 50; rifle barrel 51; bayonet catch/clip 52 a/k/a bayonet lug; barrel ring 53; end ring 53A; and mil spec 1913 accessory rail 59.

Figure 8B:
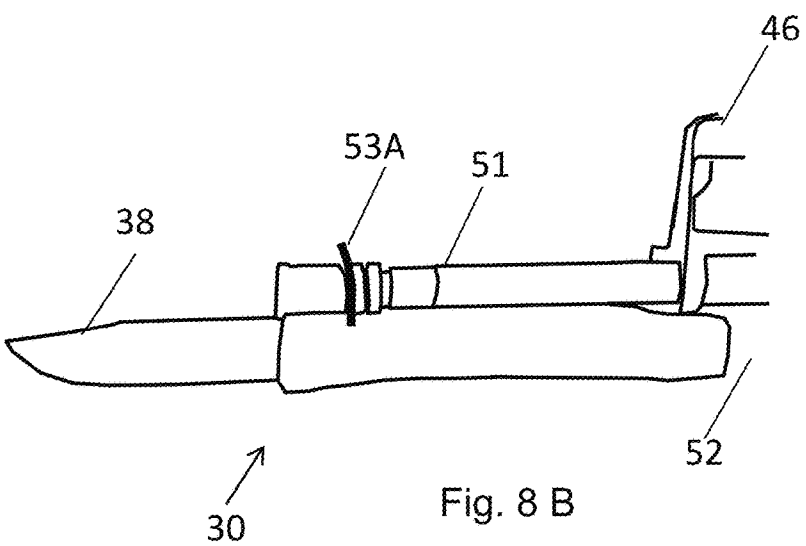
FIG. 8A through 8C are sketches of the mounted knife on the catch and ring for a rifle.
Figure 8C:
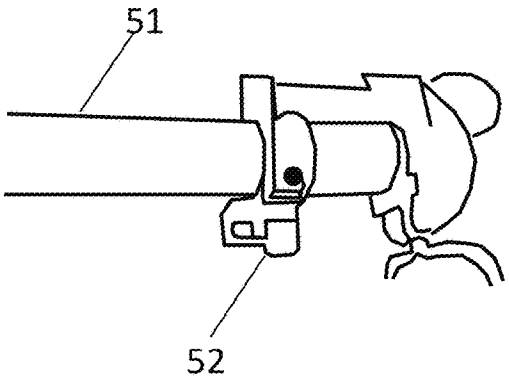
Figure 8A:
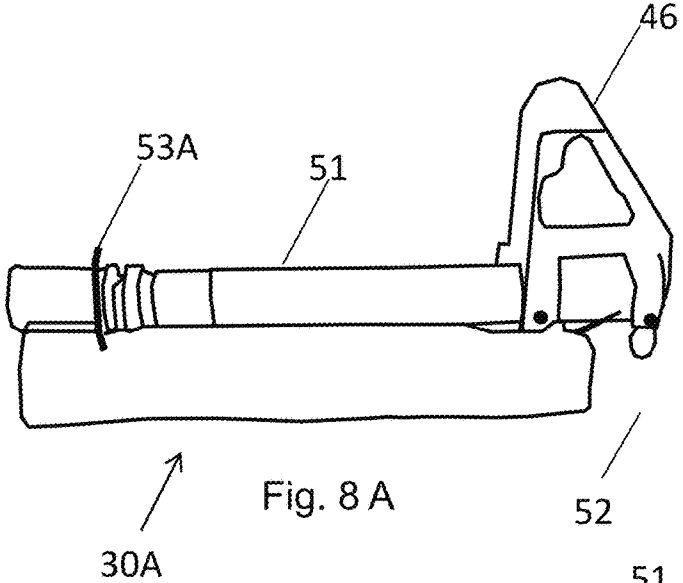
Figure 9B:
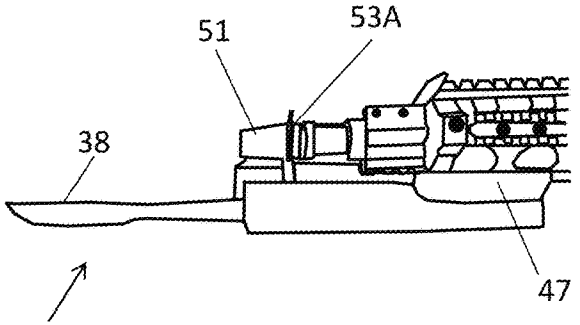
FIG. 9A through 9E are sketches of the mounted knife using a ring and slide.
Figure 9D:
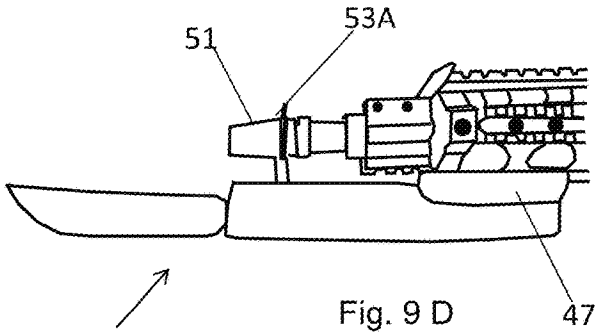
Figure 9E:
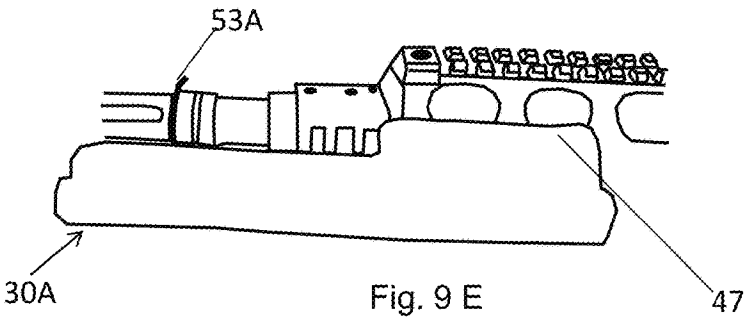
Figure 9A:
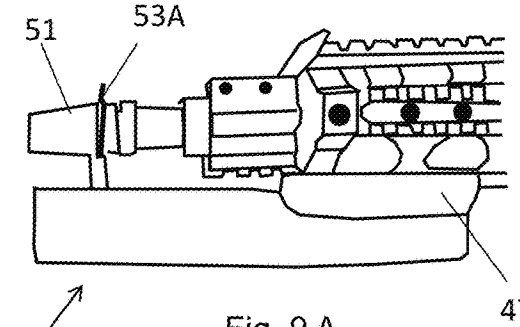
Figure 9C:
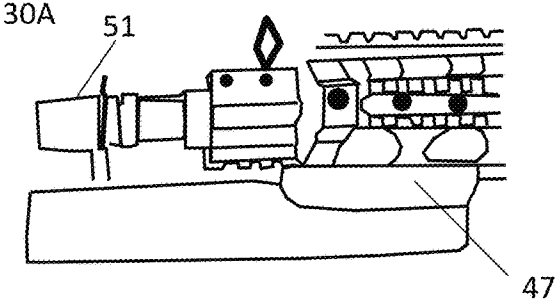
Figure 10B:
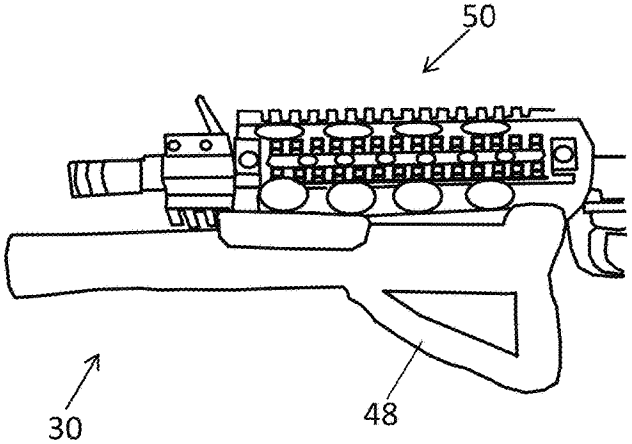
FIG. 10A through 10D are sketches of the knife mounted with a slide and including a grip.
Figure 10D:
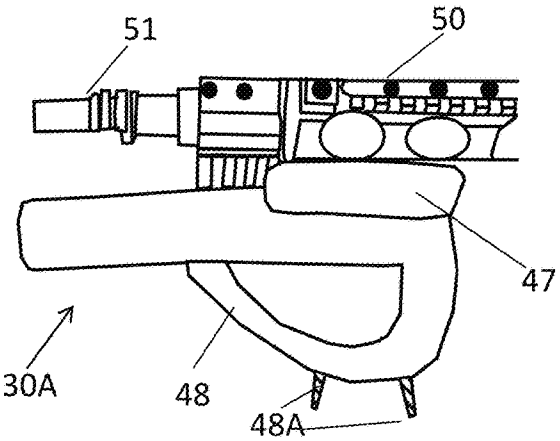
Figure 10A:
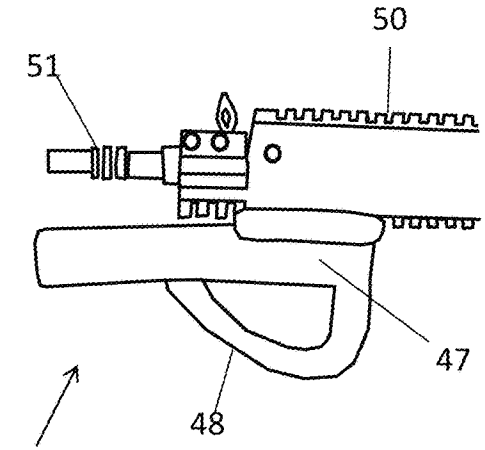
Figure 10C:
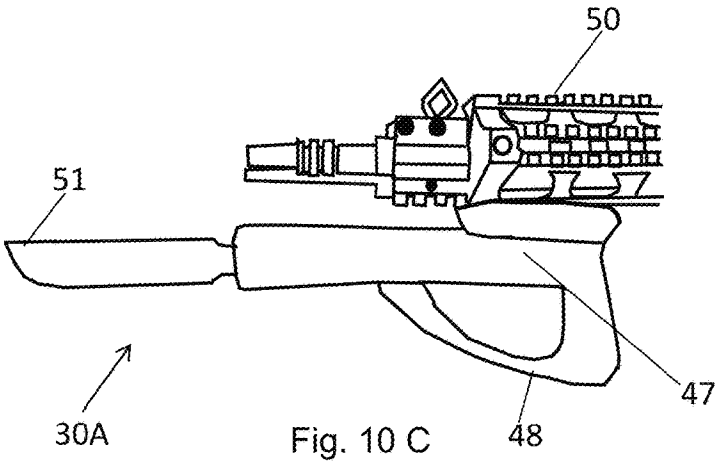

FIGS. 8A through 8C are sketches of the mounted knife on the catch 52 and ring 53 for a rifle. This shows another mounting style. Here is shown the automatic out the front knife transformed as a bayonet device 30; closed automatic knife—ready for extension 30A; blade 38; gun sights 46; rifle barrel 51; bayonet catch/clip 52 a/k/a bayonet lug; end ring 53A; and mil spec 1913 accessory rail 59.

FIGS. 9A through 9E are sketches of the mounted knife using a ring 53A and slide 47. Demonstrated components are: automatic out the front knife transformed as a bayonet device 30; closed automatic knife—ready for extension 30A; slide keep 47; end ring 53A; and mil spec 1913 accessory rail 59.

FIGS. 10A through 10D are sketches of the knife mounted with a slide 47 and including a grip 48. Components shown here are: automatic out the front knife transformed as a bayonet device 30; closed automatic knife—ready for extension 30A; slide keep 47; grip 48; grip barbs 48A; rifle 50; rifle barrel 51 and mil spec 1913 accessory rail 59.

Figure 11A:
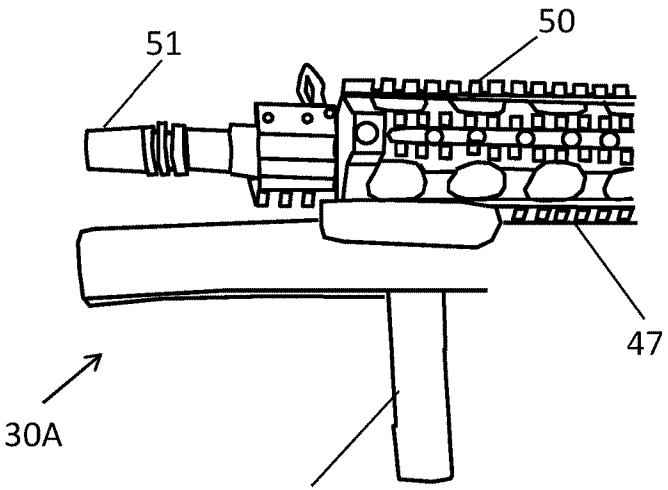
FIG. 11A through 11C are sketches of the knife mounted with a slide and "flipout" grip flash light.
Figure 11C:
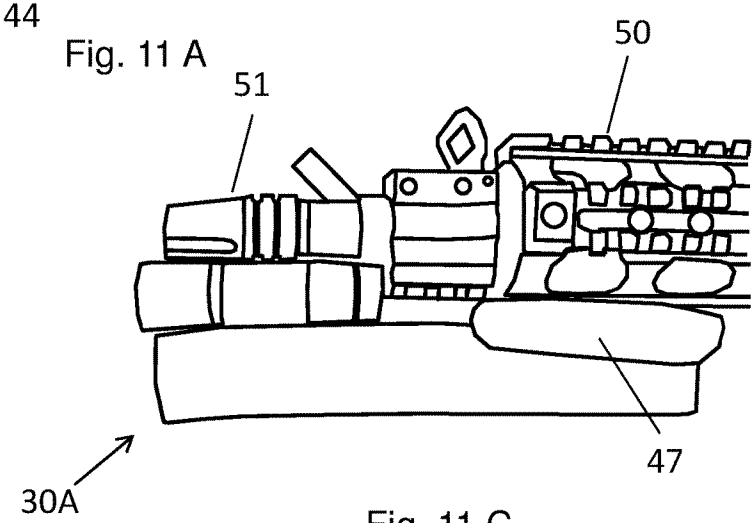
Figure 11B:
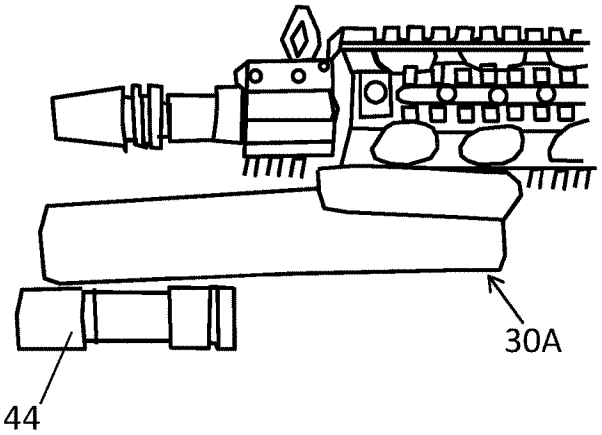
Figure 12B:
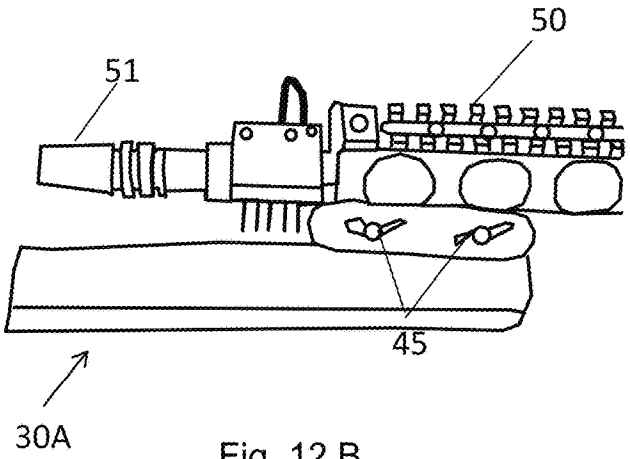
FIG. 12A through 12D are sketches of general automatic out of front knife with a slide and quick fasteners (here wing nuts) and optional grip.
Figure 12D:
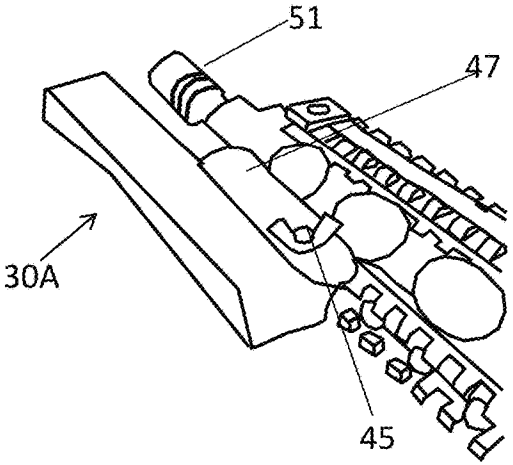
Figure 12A:
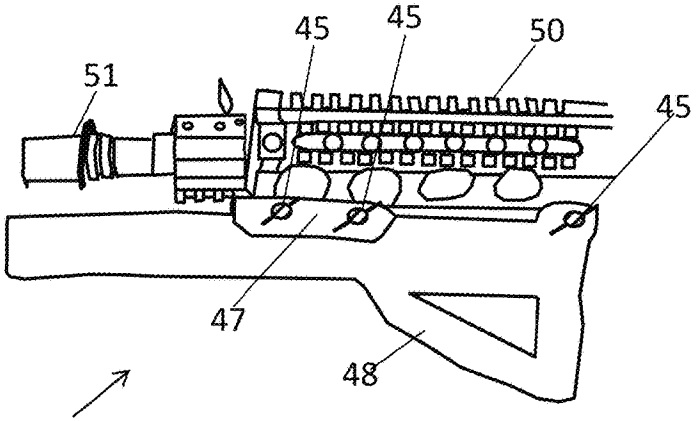
Figure 12C:
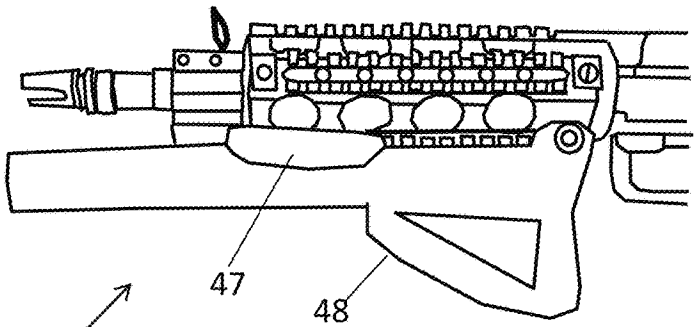

FIGS. 11A through 11C are sketches of the knife mounted with a slide and "flipout" grip/flash light 44. Shown are: closed automatic knife—ready for extension 30A; flashlight/vertical extension structure 44; slide keep 47; rifle 50; rifle barrel 51; and mil spec 1913 accessory rail 59.

FIGS. 12A through 12D are sketches of general automatic out of front knife with a slide 47 and quick fasteners 45 (here wing nuts) and optional grip. Additional connection methods and components shown here include: closed automatic knife—ready for extension 30A; fastener 45 (quick) wing nut, thumb screw or pair of thumb screws, or equal; slide keep 47; grip 48; rifle 50; rifle barrel 51; and mil spec 1913 accessory rail 59.

Figure 13B:
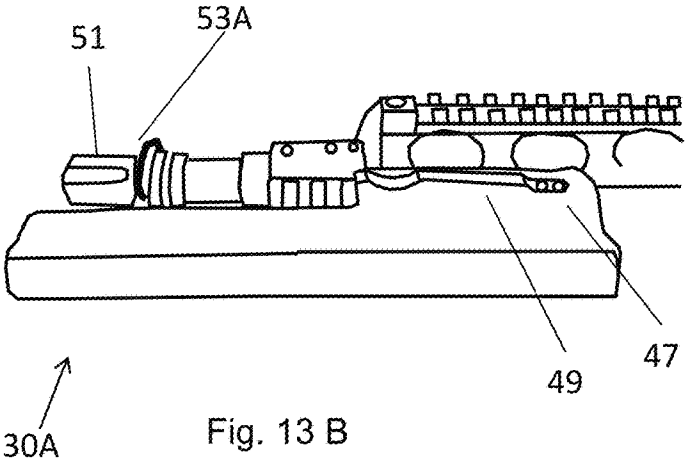
FIG. 13A through 13C are sketches of the general automatic out of the front knife device with a slide and latch mechanism.
Figure 13A:
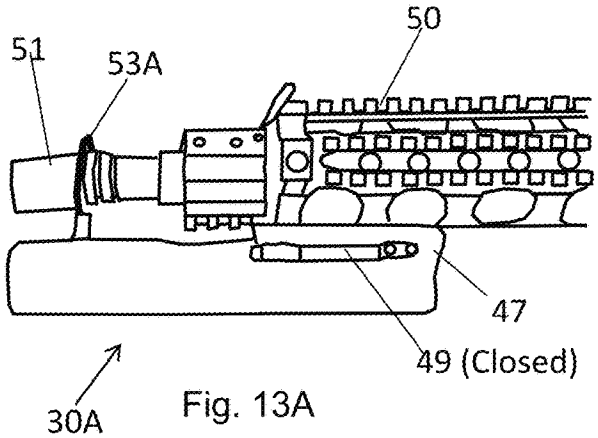
Figure 13C:
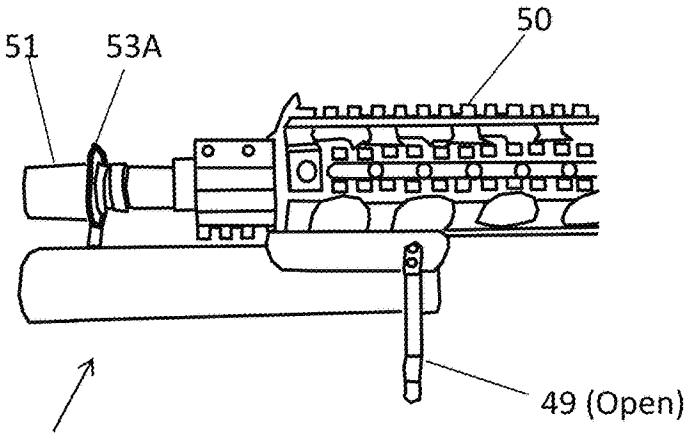

FIGS. 13A through 13C are sketches of the general automatic out of the front knife device with a slide 47 and latch mechanism 49 (hinged or pinned). Demonstrated are automatic out the front knife transformed as a closed automatic knife—ready for extension 30A; slide keep 47; latch 49 (hinged or pinned; open and shut/closed); rifle 50; rifle barrel 51; and end ring 53A.

Figure 14B:
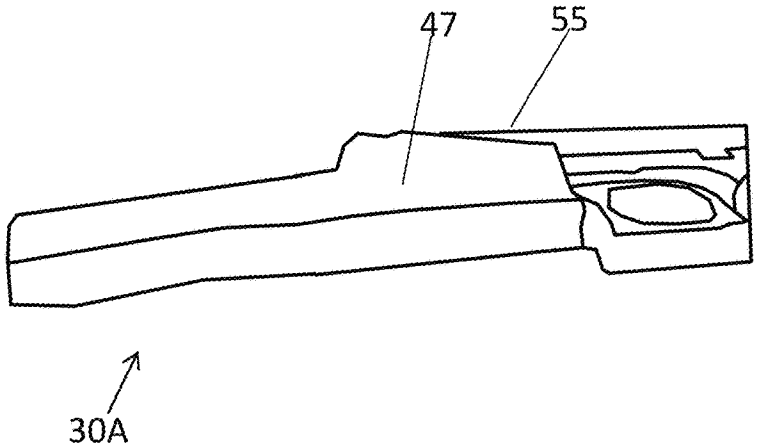
FIG. 14A through 14C are sketches of the automatic knife mounted to a pistol.
Figure 14A:
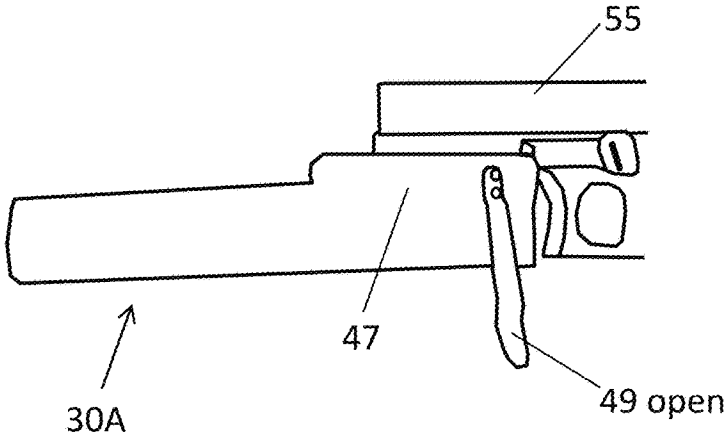
Figure 14C:
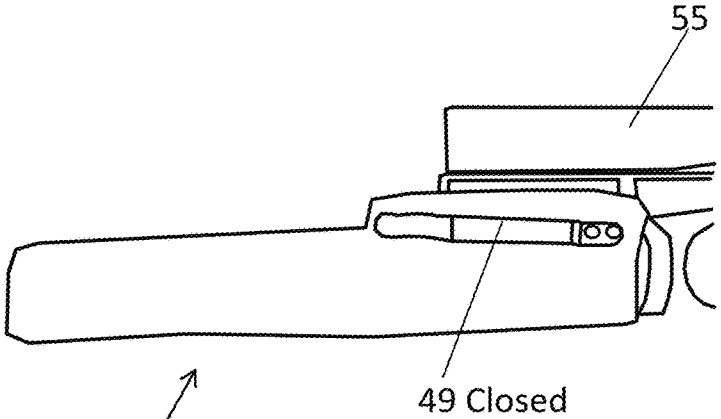

FIGS. 14A through 14C are sketches of the automatic knife mounted to a pistol 55. Demonstrated are automatic out the front knife transformed as a closed automatic knife—ready for extension 30A; slide keep 47; latch 49 (hinged or pinned, open and shut/closed); and pistol 55.

Figure 15B:
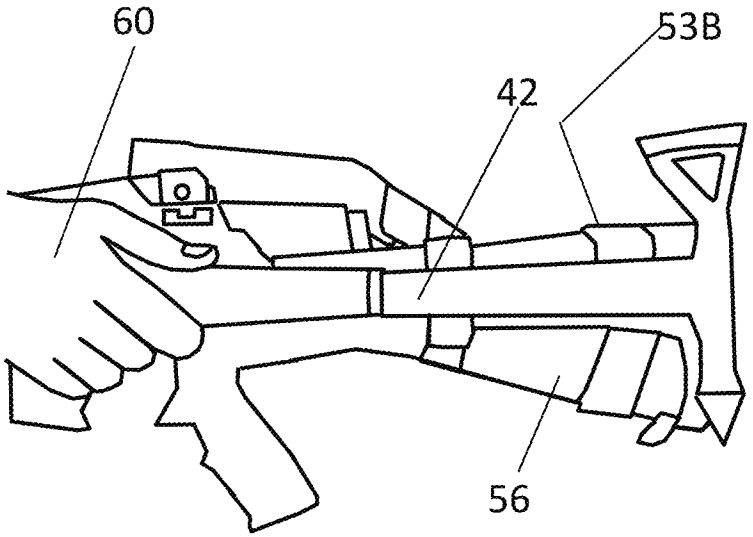
FIGS. 15A and 15B are sketches of a quick connect for a tomahawk to a rifle barrel and stock.
Figure 15A:
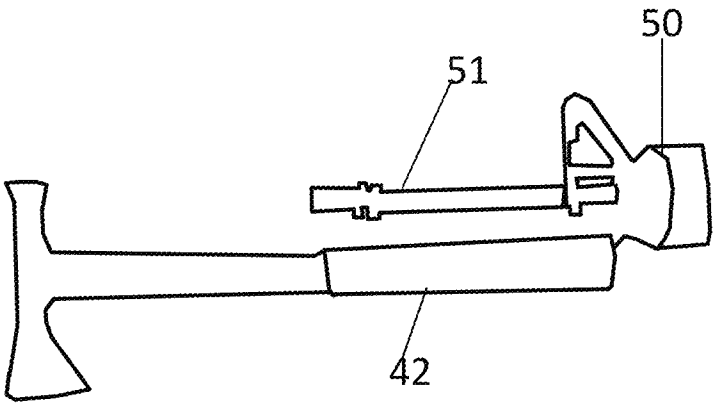
Figure 16A:
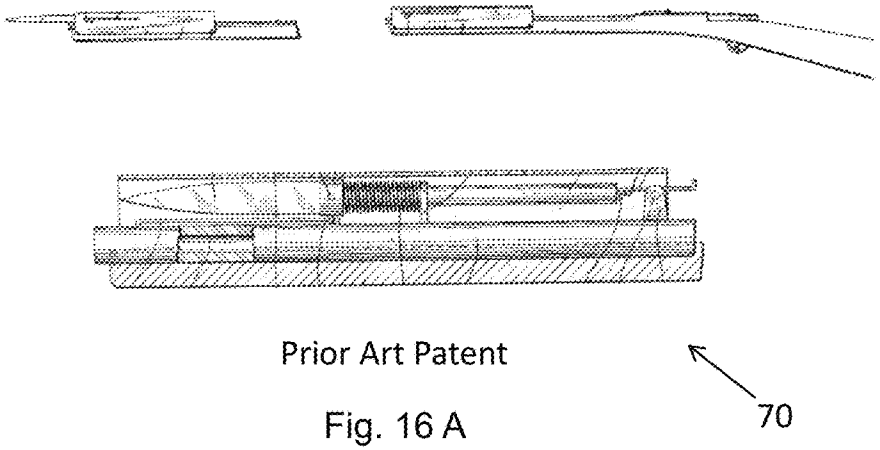
Figure 16B:
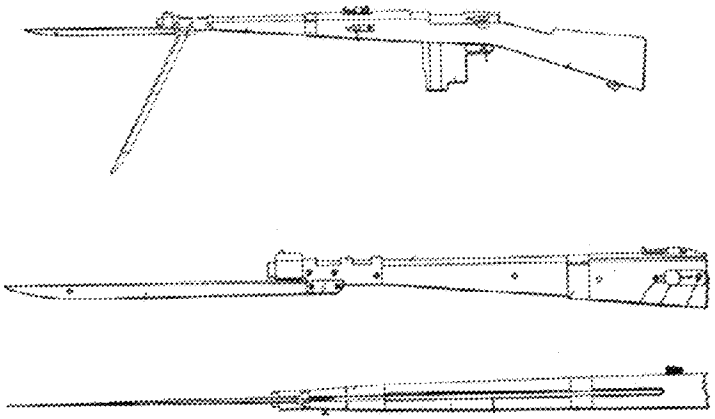
Figure 16C:
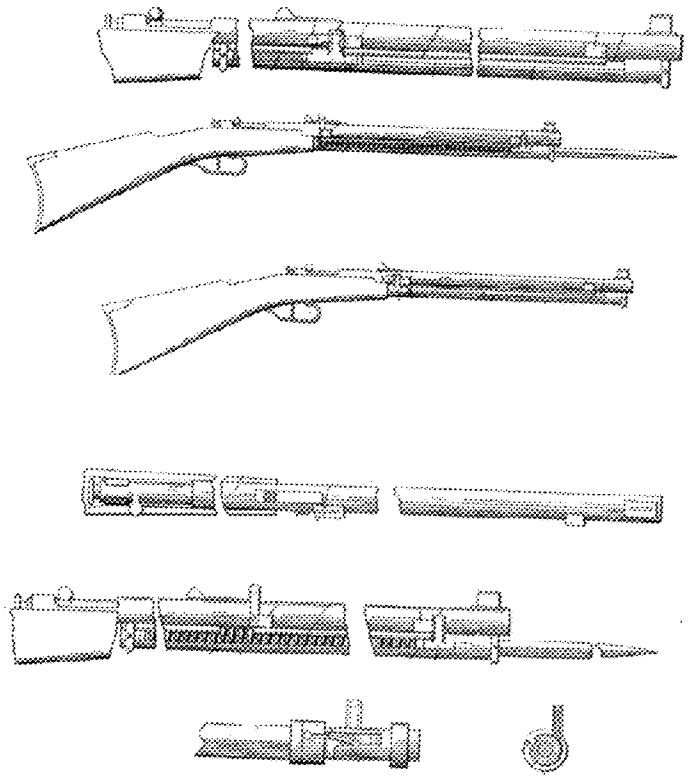
Figure 17B:
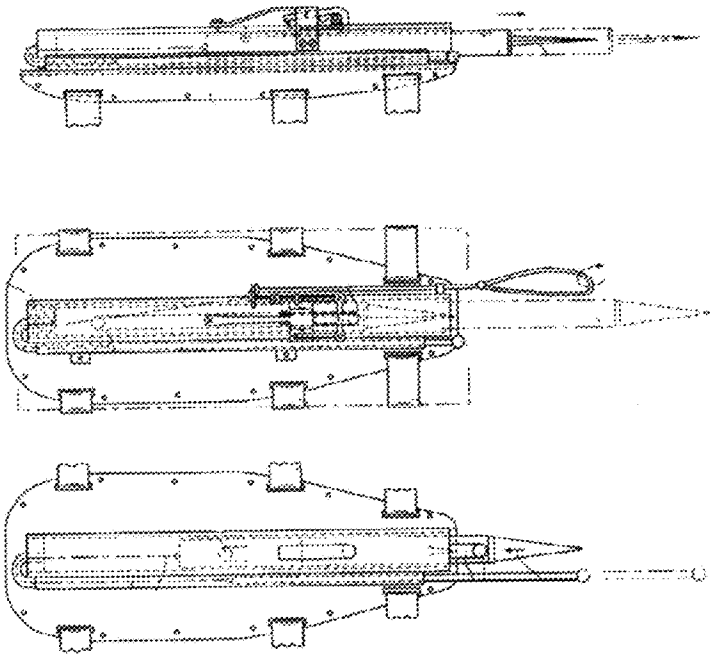
Figure 17A:
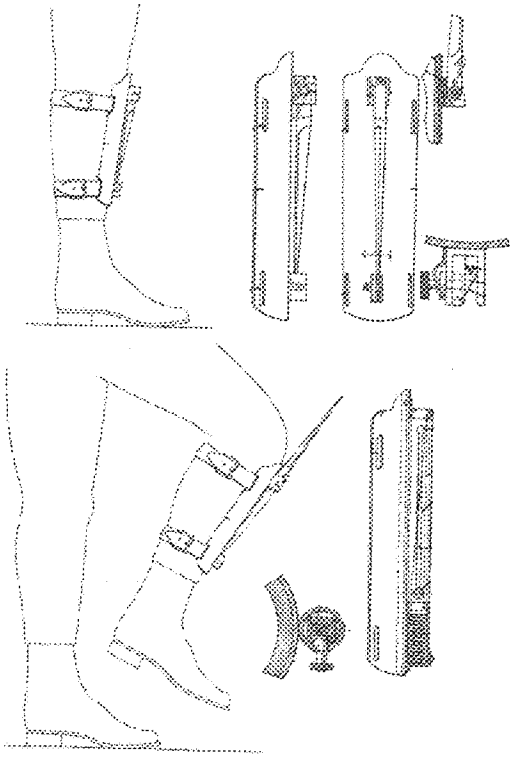

FIGS. 15A and 15B are sketches showing a quick connect for a tomahawk 42 to a rifle barrel 51 (with a stock ring 53B) and stock 56. The sketches speak for themselves.

FIGS. 16A through 16C, FIGS. 17A and 17B, and FIGS. 18A through 18C are sketches of prior art. Here former patents and applications for various bayonets and knife devices are shown. These include: prior Art 70 U.S. Pat. No. 1,290,807; prior Art 71 U.S. Pat. No. 2,330,638; prior Art 72 U.S. Pat. No. 1,055,416; prior Art 73 U.S. Pat. No. 2,665,478; prior Art 74 U.S. Pat. No. 5,722,169; prior Art 75U.S. Pat. No. 1,260,827; prior Art 76 U.S. Pat. No. 1,314,672; and prior Art 77 U.S. Pat. No. 545,528. As can be seen, the special automatic out the front knife transformed as a bayonet device is a unique combination and use as described herein.

The details mentioned here are exemplary and not limiting. Other specific components and manners specific to describing a special automatic out the front knife transformed as a bayonet device 30 may be added as a person having ordinary skill in the field of the art of bayonet, knife sporting and military defensive and offensive weapons devices and their uses well appreciates.

OPERATION OF THE PREFERRED EMBODIMENT

The special automatic out the front knife transformed as a bayonet 30 has been described in the above embodiment. The manner of how the device operates is described below. One notes well that the description above and the operation described here must be taken together to fully illustrate the concept of the special automatic out the front knife transformed as a bayonet device 30. The preferred embodiment of the special automatic out the front knife transformed as a bayonet device to be used with a weapon such as a rifle, shotgun or pistol is comprised of: (a) an out-the front, encased spring activated blade component; and (b) at least one means for connecting the blade component to the weapon wherein the out-the front, encased spring activated blade component can be removably secured to the rifle, shotgun or pistol for use as a bayonet or the like.

The special automatic out the front knife transformed as a bayonet device 30 operates somewhat similar to a conventional bayonet in that it is mounted in various ways to a rifle 50 or pistol 55. One notes that the automatic out the front knife transformed as a bayonet device 30 mounts the directly to the pistol 55 or rifle 50 by using the fastener 45 (quick) wing nut, thumb screw or pair of thumb screws, or equal; the slide keep 47; latch 49 (hinged or pinned); bayonet catch/clip 52 a/k/a bayonet lug; barrel ring 53; and/or end ring 53A. The knife 35 may be actuated to automatically thrust the knife blade 38 out the front, then equally the blade 38 be retracted automatically. These features are well known in the field of knives by a person of ordinary skill in this field.

Many uses are anticipated for the special automatic out the front knife transformed as a bayonet device 30. Some examples, and not limitations, are shown in the following Table.

| ITEM | DESCRIPTION |
|---|---|
| 1 | Sporting devices with rifles, pistols, shotguns, etc. |
| 2 | Military and homeland security offensive and defensive weaponry |
| 3 | Law enforcement offensive and defensive weaponry |
| 4 | Showcase item for display as a novelty item |
| 5 | As a knife, in and of itself |

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described. All patents and publications mentioned herein, including those cited in the Background of the application, are hereby incorporated by reference to disclose and described the methods and/or materials in connection with which the publications are cited.

The publications discussed herein are provided solely for their disclosure prior to the filing date of the present application. Nothing herein is to be construed as an admission that the present inventions are not entitled to antedate such publication by virtue of prior invention. Further, the dates of publication provided may be different from the actual publication dates which may need to be independently confirmed.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

Thus the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

As used herein, spatial or directional terms, such as "left," "right," "front," "back," and the like, relate to the subject matter as it is shown in the drawing FIGS. However, it is to be understood that the subject matter described herein may assume various alternative orientations and, accordingly, such terms are not to be considered as limiting. Furthermore, as used herein (i.e., in the claims and the specification), articles such as "the," "a," and "an" can connote the singular or plural. Also, as used herein, the word "or" when used without a preceding "either" (or other similar language indicating that "or" is unequivocally meant to be exclusive—e.g., only one of x or y, etc.) shall be interpreted to be inclusive (e.g., "x or y" means one or both x or y). Likewise, as used herein, the term "and/or" shall also be interpreted to be inclusive (e.g., "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as have, having, include, and including should be construed to be synonymous with the terms comprise and comprising.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

With this description it is to be understood that the special automatic out the front knife transformed as a bayonet 30 is not to be limited to only the disclosed embodiment of product. The features of the special automatic out the front knife transformed as a bayonet device 30 are intended to cover various modifications and equivalent arrangements included within the spirit and scope of the description.

What is claimed is:

1. A special automatic knife device that extends out a front of a weapon, the automatic knife device is transformed as a bayonet and is used in conjunction with the weapon and the automatic knife device is comprised of:

(a) an out-the front, single button activated encased spring and blade component; and (b) at least one fastener that connects the blade component to the weapon wherein the out-the front, encased single button activated spring and blade component is secured to the weapon as the bayonet and wherein a blade is extended or retracted by pushing a single button.

2. The device in claim 1 further comprised of a grip.

3. The device in claim 2 further comprised of at least one grip barb.

4. The device in claim 1 further comprised of a vertical extension structure for holding the weapon with at least two hands.

5. The device in claim 1 wherein the at least one fastener that connects the blade component to the weapon is a bayonet catch/clip also known as a bayonet lug fastener.

6. The device in claim 5 further comprised of a barrel ring.

7. The device in claim 1 wherein the at least one fastener that connects the blade component to the weapon is a wing nut.

8. The device in claim 1 wherein the fastener for connecting the blade component to the weapon is a pair of thumb screws.

9. A special automatic knife device that extends out a front of a weapon, the automatic knife device is transformed as a bayonet and is used in conjunction with the weapon and the automatic knife device is comprised of:

(a) an out-the front, single button activated encased spring and blade component; and (b) a bayonet catch/clip, also known as a bayonet lug fastener, and (c) a barrel ring wherein the out-the front, single button activated encased spring and blade component is secured to the weapon as the bayonet and wherein a blade is extended or retracted by pushing a single button.

10. The device in claim 1 wherein the weapon is selected from a group consisting of a rifle, a shotgun and a pistol.

11. The device in claim 10 wherein the weapon is selected from a group consisting of a rifle, a shotgun and a pistol.

* * * * *